US006341771B1

(12) United States Patent
Sasson, Jr.

(10) Patent No.: US 6,341,771 B1
(45) Date of Patent: Jan. 29, 2002

(54) METHOD OF STACKING STRIPS OF FLEXIBLE MATERIAL

(75) Inventor: Peter Gerald Sasson, Jr., Stow, OH (US)

(73) Assignee: The Goodyear Tire & Rubber Company, Akron, OH (US)

( * ) Notice: Subject to any disclaimer, the term of this patent is extended or adjusted under 35 U.S.C. 154(b) by 0 days.

(21) Appl. No.: 09/491,220

(22) Filed: Jan. 25, 2000

(51) Int. Cl.[7] ..... B65H 45/101

(52) U.S. Cl. ..... 270/39.05; 414/789.5; 414/793.8; 493/413; 225/104

(58) Field of Search ..... 270/39.01, 39.02, 270/39.05; 493/412, 357, 362, 410, 413; 414/789.5, 793.8; 226/104, 105, 106, 107

(56) References Cited

U.S. PATENT DOCUMENTS

| | | | | |
|---|---|---|---|---|
| 1,880,820 A | | 10/1932 | Conant | |
| 2,196,921 A | | 4/1940 | Hurxthal | 271/2.2 |
| 2,993,356 A | | 7/1961 | Archibald | 68/158 |
| 3,032,337 A | | 5/1962 | Holman | 270/79 |
| 4,166,561 A | | 9/1979 | Bruckner et al. | 226/105 |
| 4,444,388 A | | 4/1984 | Stefannson et al. | 271/293 |
| 4,650,178 A | | 3/1987 | Steele et al. | 271/305 |
| 4,708,332 A | * | 11/1987 | Besemann | 270/39.05 |
| 4,750,724 A | * | 6/1988 | Herd et al. | 270/39.02 |
| 4,805,894 A | | 2/1989 | Scherer et al. | 271/297 |
| 4,841,714 A | | 6/1989 | Meier | 53/429 |
| 4,842,573 A | * | 6/1989 | Peter et al. | 270/39.02 X |
| 5,058,872 A | * | 10/1991 | Gladow | 270/39.01 X |
| 5,242,366 A | * | 9/1993 | Kita | 270/39.05 X |
| 5,558,318 A | * | 9/1996 | Crowley et al. | 270/39.05 |
| 5,820,539 A | * | 10/1998 | Strahm | 270/39.05 X |

FOREIGN PATENT DOCUMENTS

| | | | |
|---|---|---|---|
| JP | 408151168 | * | 6/1996 |
| JP | 408155972 | * | 6/1996 |

* cited by examiner

*Primary Examiner*—Christopher P Ellis
*Assistant Examiner*—Patrick Mackey
(74) *Attorney, Agent, or Firm*—Nancy T. Krawczyk

(57) ABSTRACT

A method of converting at least one strip of flexible material 12 into at least one stack of folded members 46. The method includes the step of conveying a number of festoons 20 formed from a strip of flexible material 12. The method is characterized by the step of depositing the respective festoons 20 into a stack of folded members 46. In the preferred method, the step of depositing the respective festoons 20 into a stack of folded members 46 can be characterized further by the steps of: (i) laying an initial flap 36 of flexible material 12 on a stacking surface 24; (ii) creating a first folded member 44 by placing a first festoon 42 on the initial flap 36 of flexible material 12; and (iii) creating additional folded members by placing each festoon upon a preceding festoon.

10 Claims, 6 Drawing Sheets

METHOD OF STACKING STRIPS OF FLEXIBLE MATERIAL

TECHNICAL FIELD

This invention relates to a method of converting a strip of flexible material into a stack of folded members and, more particularly, to a stack having at least one side where all of the folded members are aligned.

BACKGROUND ART

The need to convert a strip of flexible material into a stack of folded members arises in many industries, such as the textile and rubber industries. In the rubber industry, one such need arises when processed rubber is to be used in injection molding machines. A method of processing rubber, either synthetic or natural, begins by dumping the necessary raw materials into the hopper of a Banbury. After the raw materials are properly mixed, the resulting rubber is conveyed to a screw feeder which further mixes the rubber and conveys it to a calender. The calender includes a pair of rollers that transform the screw fed rubber into a wide strip of rubber. Generally, this wide strip of rubber has a width of between thirty inches (76.2 cm) and thirty-six inches (91.44 cm). If this rubber is to be used in an injection molding machine, it must be cut into narrow strips. Injection molding machines typically will only accept rubber strips with a width of six inches (15.24 cm) or less. To load these strips into an injection molding machine, an operator feeds an end of a narrow rubber strip into an inlet of the injection molding machine. After accepting the end of the narrow strip of rubber, the injection molding machine automatically draws the strip into the inlet as needed.

To efficiently produce injection molded rubber products, rubber manufacturers need an efficient way to produce these narrow strips of rubber and to transport these strips of rubber to the location of the injection molding machines. Since most manufacturing plants are already equipped to move palletieed products, the easiest way to sport a product from one location to another is to stack the product and transport it on a pallet.

If the product is to be transported by pallet, a rubber manufacturer can either cut the wide strip of rubber into narrow strips prior to palletizing, or they can palletize the wide strip and then cut it into narrow strips. Whichever method is used to reduce the width of the rubber strips, there is a need to neatly stack the rubber. If the rubber is cut into narrow strips prior to stacking, the stacks must be neat to assure that a first narrow strip is not overlapped by a second narrow strip. If the second narrow strip overlaps the first narrow strip, the first narrow strip will likely break when being drawn into the injection molding machine. The overlap of the second narrow strip applies a tension to the first narrow strip of flexible material causing it to stretch and break if the first narrow strip breaks, the remaining end of the strip must be manually fed into the inlet of the injection molding machine. If the wide strip of rubber is stacked prior to being cut, the stacks must be neat to assure that when cut, the narrow strips will have a relatively uniform width. If the rubber is sloppily stacked, cutting the stack at various points will result in narrow strips with their widths varying along their length. A single strip could have a width of one inch at one point and a width of ten inches at another point. As a result, the narrow strip may easily break when being drawn into the injection molding machine or the strip may be too wide to properly fit into the inlet of the injection molding machine. In either case, manual labor may be required to either feed the remaining end of the narrow strip into the injection molding machine or to trim the narrow strip down to a size that the injection molding machine can utilize.

Currently, after exiting the calender, the wide strip of rubber is either placed on a festoon type conveyor or cut into narrow strips, and the narrow strips placed on the festoon type conveyor. On the festoon conveyor, each strip is hung over a series of bars and allowed to suspend loosely between the bars. The festoon conveyor carries the respective strip or strips of rubber through a cooling chamber where the rubber is cooled. After leaving the cooling chamber on the festoon conveyor, a belt conveyor removes the respective strip or strips from the festoon conveyor. The belt conveyor moves the respective strip or strips to a wigwag device for stacking.

The wigwag device is a simple mechanical device having a surface that moves back and forth at a constant speed to stack a respective strip into folded members. The stack created by the wigwag device is very messy. This is especially true when the wigwag is attempting to stack multiple narrow strips at one time because the narrow strips can easily overlap one another. Additionally, the wigwag device does not assure that each folded member of a respective strip is flatly placed on top of the previous folded member of that strip. When the respective folded members are not lying flatly, there is a greater likelihood that overlapping of the respective strips will result.

U.S. Pat. No. 3,032,337 entitled "CONTINUOUS STACKING SYSTEM" discloses a system to stack a continuous ribbon of material. This system positions a belt conveyor directly above the slab where the ribbon is to be stacked. An oscillating wall is used to help lay down the first portion of the ribbon and the remaining portions of the ribbon are placed by the side to side motion of the ribbon that results from the oscillating wall laying down the first ribbon.

SUMMARY OF THE INVENTION

This invention discloses a method of converting at least one strip of flexible material into at least one stack of folded members. The method includes the step of conveying a number of festoons formed from a strip of flexible material. The method is characterized by the step of depositing the respective festoons into a stack of folded members.

The step of depositing the respective festoons into a stack of folded members can be characterized further by the steps of: (i) laying an initial flap of flexible material on a stacking surface; (ii) creating a first folded member by placing a first festoon on the initial flap of flexible material; and creating additional folded members by placing each festoon upon a preceding festoon.

The method of this invention results in a stack having at least one side where the folded members are aligned. A further aspect of this invention provides additional steps that can be utilized to align additional sides of the stack.

BRIEF DESCRIPTION OF DRAWINGS

The invention will be described by way of example and with reference to the accompanying drawings in which.

DETAILED DESCRIPTION OF THE INVENTION

Figure 1:
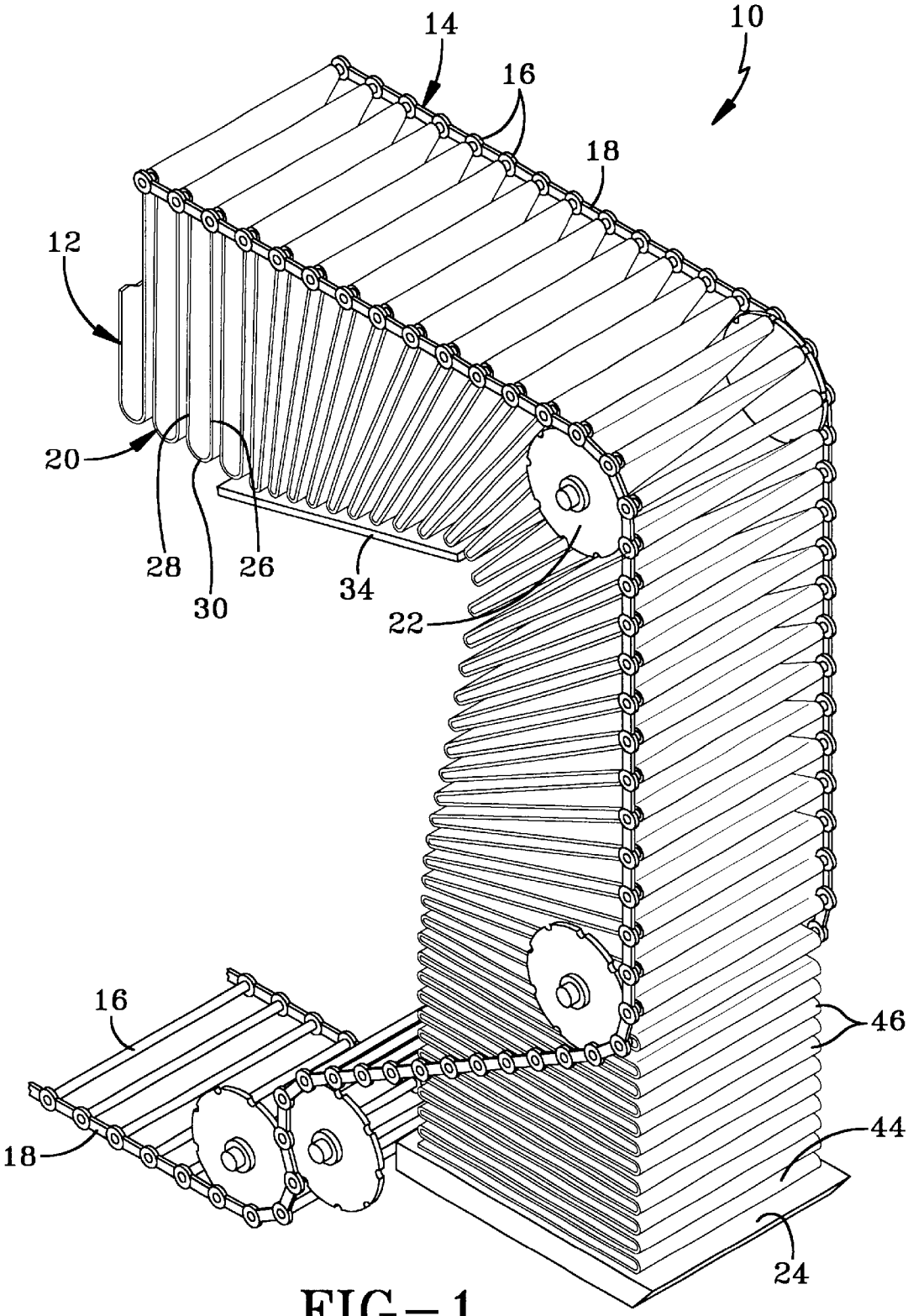
FIG. 1 is a view of an apparatus that may be used to perform the preferred method of the invention.

FIG. 1 shows an apparatus 10 for performing the preferred method of the invention. As shown, at least one strip of flexible material 12 has been placed on a festoon type conveyor 14. The festoon type conveyor 14 consists of a series of parallel bars 16, or other like supports, that are held between two drive chains 18. The drive chains 18 are driven by at least one motor driven pulley. When placed on the conveyor 14, the flexible material 12 is allowed to suspend loosely between the respective bars 16 to form a number of festoons 20. The respective bars 16 of the conveyor 14 that provide support for the festoons 20 of flexible material 12 are referred to as material supporting bars.

After being placed on the conveyor 14, the festoons 20 are conveyed along a path of the conveyor 14 such that the orientation of the festoons 20 is maintained. The orientation of the respective festoons 20 is changed as the respective material supporting bars 16 travel around a pulley 22 and begins to move in a downward direction toward a stacking surface 24. As the respective bars 16 pass around the perimeter of the pulley 22, the material supporting bar 16 for a leading surface 26 of each festoon 20 travels to a position below the material supporting bar 16 for a trailing surface 28 of that respective festoon 20. As a result, the leading surface 26 of each festoon 20 lies on either the trailing surface 28 of a preceding festoon or, where there is no preceding festoon, on a preceding bar 32 on the conveyor 14. A preceding festoon is a festoon on the conveyor immediately preceding the festoon at issue. This change in orientation of the respective festoons 20 may be aided by the use of a deflection surface 34. The deflection surface 34 may be used to help separate the respective festoons 20 when the orientation is changed, especially when the flexible material 12 has an adhesive characteristic. The use of the deflection surface 34 will allow freer movement of each festoon 20.

Figure 2:
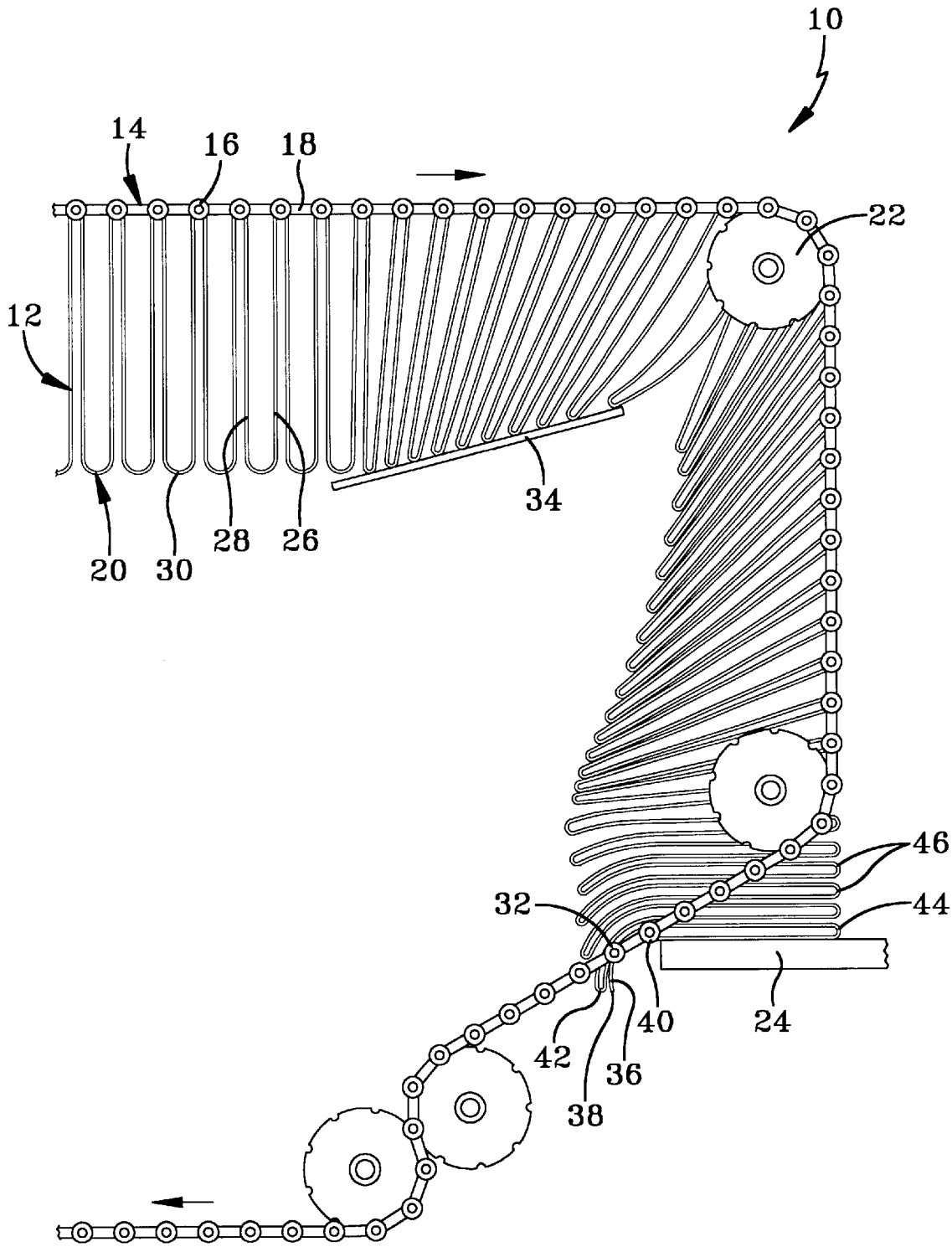
FIG. 2 is a view of the stacking surface contacting an initial flap of flexible material and moving to cause the initial flap to lie flatly on its surface.

As seen in FIG. 2, after the orientation of the respective festoons 20 has been changed, a movable stacking surface 24 is used to contact an initial flap 36 of the flexible material 12. The initial flap 36 of flexible material 12 is located between a leading edge 38 of the flexible material 12 and the first material supporting bar 40. The first material supporting bar 40 supports the initial flap 36 of flexible material 12. After the change in orientation, the initial flap 36 of the flexible material 12 will be lying against the preceding bar 32 on the conveyor 14. The preceding bar 32 is the bar 16 not supporting any flexible material 12, immediately preceding the first material supporting bar 40. The movable stacking surface 24 is inserted into an area between the first material supporting bar 40 and the proceeding bar 32. The stacking surface 24 moves with the proceeding bar 32 until making contact with the initial flap 36 and causing the initial flap 36 to lie flatly upon its surface. When the stacking surface 24 is being inserted, either the conveyor 14 or the stacking surface 24 moves such that the first material supporting bar 40 moves in a horizontal direction relative to the stacking surface 24. As the first material supporting bar 40 is moved in a horizontal direction relative to the stacking surface 24, it is removed from the stack of flexible material 12. After complete removal from the stack, the first material supporting bar 40 no longer needs to be moved in a direction horizontal to the stacking surface 24 and may be moved in any direction.

Figure 3:
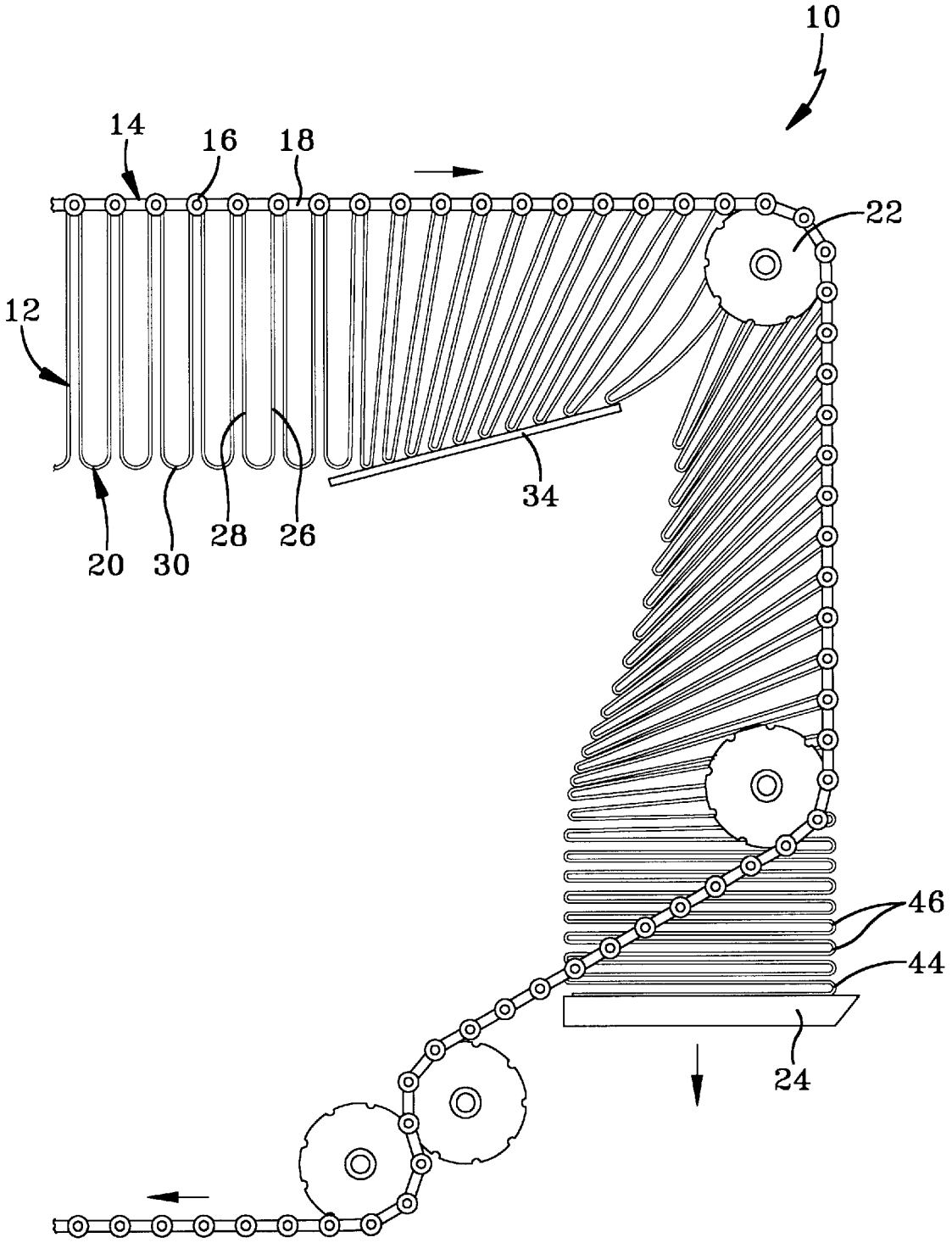
FIG. 3 is a view showing a movement of the stacking surface such that the bars being removed from the stack move in a direction horizontal, relative to the stacking surface.
Figure 4:
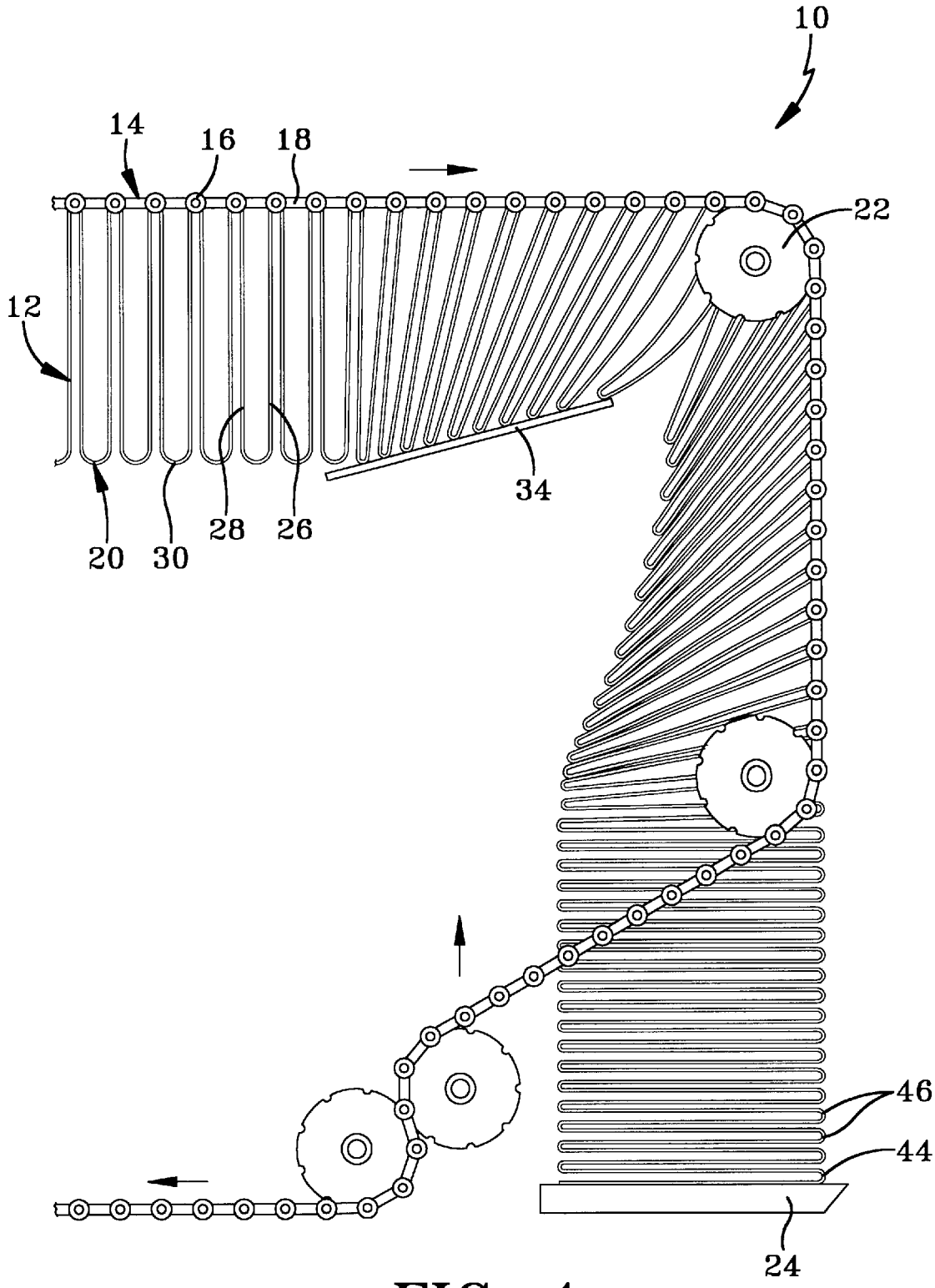
FIG. 4 is a view of the stacking surface at its low point and the conveyor moving upward such that the bars, being removed from the stack, move in a direction horizontal, relative to the stacking surface.

After changing the orientation of the festoons 20, a first festoon 42 has a leading surface 26 that is lying on the initial flap 36 of flexible material 12. As the initial flap 36 is caused to lie flatly upon the stacking surface 24, the first festoon 42 moves with the initial flap 36 into a position above the initial flap 36 on the stacking surface 24. The respective material supporting bars place this first festoon 42 on the initial flap 36 of flexible material 12, creating a first folded member 44. The leading surface 26 of the first festoon 42 lies directly on top of the initial flap 36 and the trailing surface 28 of the first festoon 42 continues to support the next festoon. As seen in FIG. 3, in the preferred method, the stacking surface 24 moves down such that the respective material supporting bar is moved in a horizontal direction with respect to the stacking surface 24 and is removed from the respective folded member 46. Each festoon is placed on the preceding festoon to create additional folded members 46. Instead of moving the stacking surface 24 down, the conveyor 14 may be moved upward, as long as the movement of the respective material supporting bars, after laying down their respective festoons 20, is in a horizontal direction relative the stacking surface 24. It is preferred that the stacking surface 24 move down with respect to the conveyor 14 until it has reached a low point, as depicted in FIG. 4. After the stacking surface 24 has reached the low point, the conveyor 14 will begin to move upward. This increases the number of folded members 46 that can be placed on the stacking surface 24 prior to removal of the stack.

Since the material supporting bars of the conveyor 14 are moved in a horizontal direction relative to the stacking surface 24 when being removed from the stack, the material supporting bars can be used to flatten each folded member and to aid in placing the next folded member. By keeping a respective material supporting bar in contact with the respective folded member as it is being removed, the respective material supporting bar can be dragged or rolled across the respective folded member to flatten it. Additionally, as each material supporting bar is being removed, it supports at least a portion of the leading surface 26 of the next festoon. As a result, the respective material supporting bar can be used to control the placement of the next festoon onto the stack. To aid in these processes, each bar 16 of the conveyor 14 may be a movable roller or have other similar features.

Since placement of the stack of folded members 46 is controlled by the respective material supporting bars, a stack created by this method will have at least one side where all the folded members 46 are aligned. At least the side of the stack of folded members 46 where the respective material supporting bars first place the festoons 20 will be aligned. A stack having all sides aligned, or straight, may be created by this method by suspending a predetermined amount of the flexible material 12 between the respective material supporting bars and by accurately placing the flexible material 12 in the same area of each material supporting bar on the conveyor 14.

Figure 5:
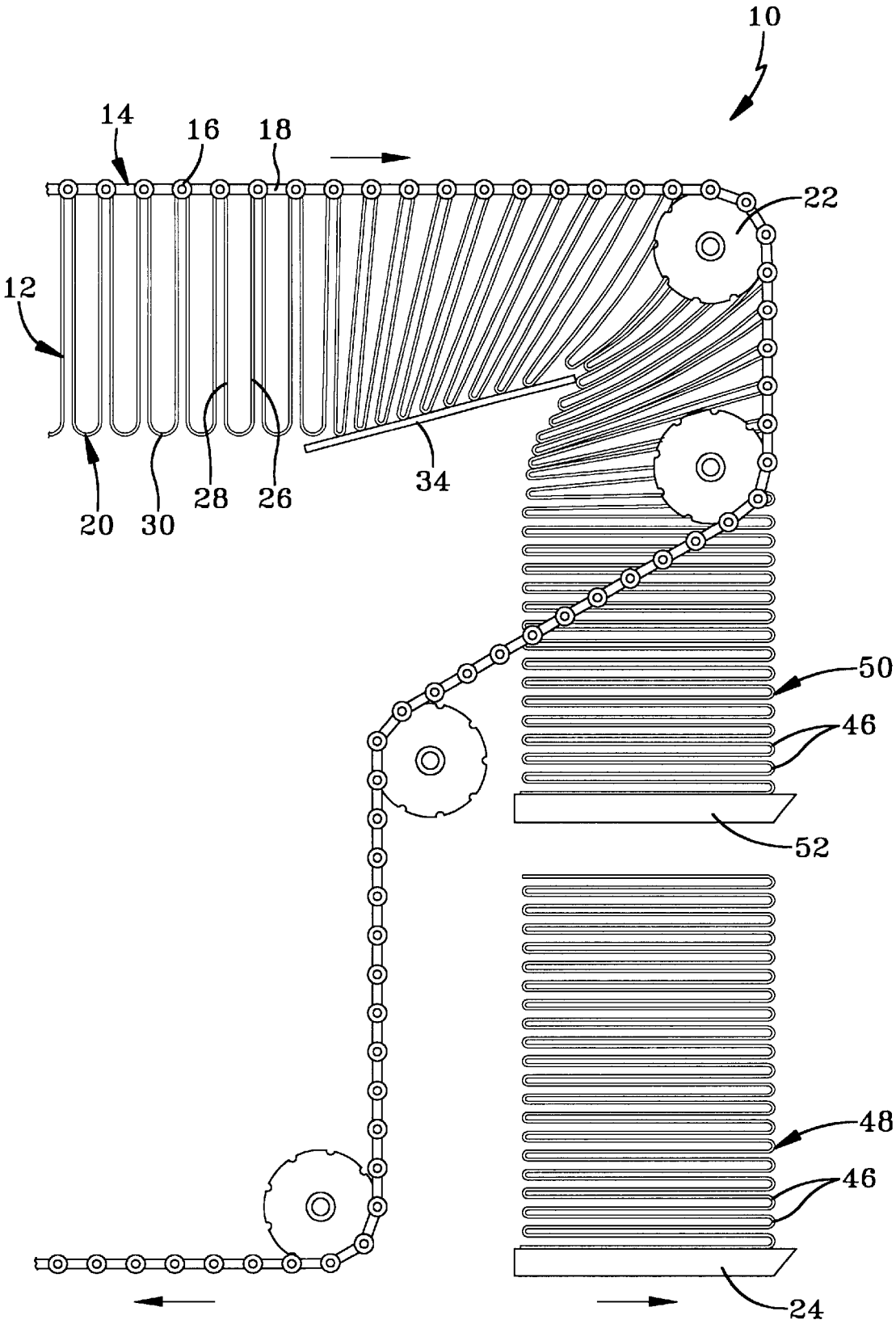
FIG. 5 is a view of a first stack of folded members under a new stack.
Figure 6:
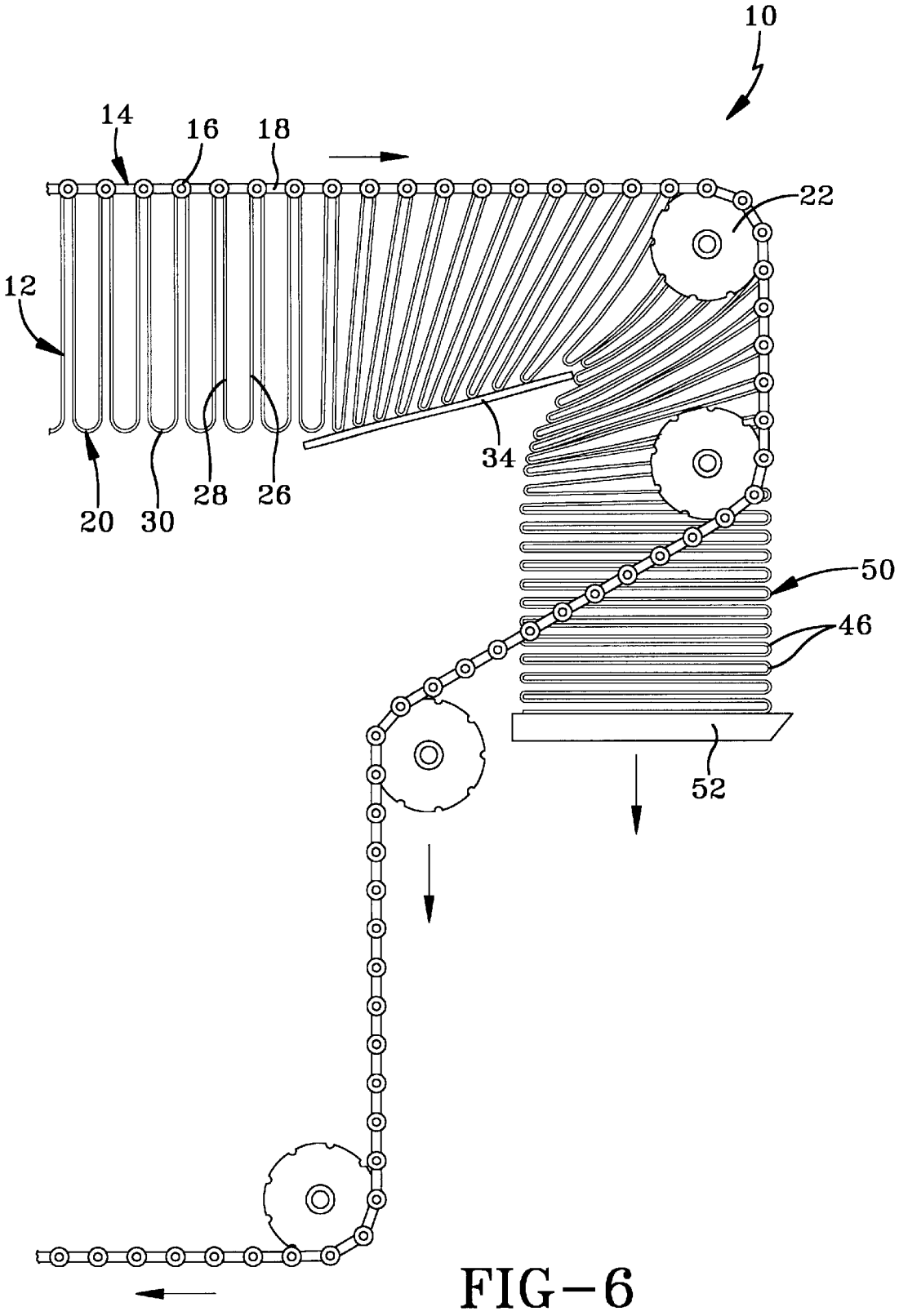
FIG. 6 is a view of the new stack of folded members on the stacking surface, and of the conveyor and stacking surface moving downward to a reset position.

Depending upon the length of the strip of flexible material 12, more than one stack of folded members 46 may be necessary. If more than one stack is necessary, the first stack 48 may be removed and a new stack 50 stated without stopping the conveyor 14. As seen in FIG. 5, when the first stack 48 of folded members 46 reaches a predetermined height, a new stacking surface 52 is inserted into the area between two of the respective material supporting bars to support the flexible material 12. The flexible material 12 is cut at the location of the new stacking surface 52. The flexible material 12 below the new stacking surface 52 is placed upon the first stack 48 and the remaining portion of flexible material 12 is stacked upon the new stacking surface 52. After all the flexible material 12 has been placed on the first stack 48, the first stack 48 is quickly removed from the area direty under the new stacking surface 52. As the new stack 50 grows, either the new stacking surface 52 can be moved down, away from the conveyor 14 or, as shown in FIG. 6, both the conveyor 14 and the stacking surface 24 can be moved down to a reset position similar to that depicted in FIG. 3.

The method of this invention converts at least one strip of flexible material 12 into at least one stack of folded members 46. The method results in a neater stack of folded members 46, having at least one side where all of the folded members 46 are aligned. If the flexible material 12 is neatly stacked, the narrow strips formed from the stacked material will be more uniform and will not be overlapped by other strips. As a result, the amount of manual labor needed to feed these strips into an injection molding machine is reduced. Additionally, the method eliminates the need for a belt conveyor and a wigwag device currently used to stack a respective strip of flexible material 12 so capital costs and floor space will be saved.

What is claimed is:

1. A method of converting at least one strip of flexible material (12) into at least one stack of folded members (46), the method including the step of:

(i) conveying a number of festoons (20) formed from a strip of flexible material (12);

the method being characterized by the step of:

(ii) directly depositing the respective festoons (20) onto a stacking surface (24) to form a stack of folded members (46).

2. A method as set forth in claim 1, the step of depositing the respective festoons (20) into a stack of folded members (46) being further characterized by the steps of:

(i) laying an initial flap (36) of flexible material (12) on a stacking surface (24);

(ii) creating a first folded member (44) by placing a first festoon (42) on the initial flap (36) of flexible material (12);

(iii) creating additional folded members by placing each festoon upon a preceding festoon.

3. A method as set forth in claim 2, the step of laying an initial flap (36) of flexible material (12) on a stacking surface (24) being further characterized by the steps of:

(i) contacting an initial flap (36) of the flexible material (12) with a movable stacking surface (24);

(ii) moving the stacking surface (24) to cause the initial flap (36) of flexible material (12) to lie flatly on the stacking surface (24).

4. A method as set forth in claim 1 being further characterized by the step of:

(i) forming the festoons (20) from a predetermined amount of the flexible material (12).

5. A method of forming a stack of folded members formed from at least one strip of flexible material, the method comprising the steps of:

(i) forming a number of festoons from a strip of flexible material;

(ii) conveying the festoons in a first direction;

(iii) conveying the festoons in a second direction;

(iv) depositing the festoons onto a stacking surface to form a stack of folded members.

6. A method as set forth in claim 5, wherein the step of depositing the festoons onto a stacking surface comprises the steps of:

(i) contacting an initial flap of the flexible material onto the stacking surface, the stacking surface being moveable;

(ii) moving the stacking surface to cause the initial flap of flexible material to lie flatly on the stacking surface.

7. An apparatus for converting at least one strip of flexible material into at least one stack of folded members, the apparatus comprising a plurality of material carrying bars for carrying at least one strip of flexible material, drive means connecting the bars together, and a stacking surface wherein the bars are driven in a horizontal direction travel after the flexible material is festooned on the bars;

the bars are then driven in a vertical direction for a defined distance directly over the stacking surface;

and at a point above the upper surface of the stacking surface, the bars are driven at an angle away from the stacking surface.

8. The apparatus of claim 7 wherein the apparatus is further comprised of a plurality of pulleys about which the drive means travel to guide and change the direction of travel of the material holding bars.

9. The apparatus of claim 8 wherein at least a pair of associated pulleys is capable of movement in the vertical direction in order to vary the defined vertical distance that the bars are driven.

10. The apparatus of claim 7 wherein the stacking surface is capable of movement in both the horizontal and vertical direction.

* * * * *